US007868834B2

(12) United States Patent
Ortigosa et al.

(10) Patent No.: US 7,868,834 B2
(45) Date of Patent: Jan. 11, 2011

(54) MINIATURE ANTENNA FOR A MOTOR VEHICLE

(75) Inventors: Enrique Martinez Ortigosa, Barcelona (ES); Carles Puente Baliarda, Barcelona (ES)

(73) Assignee: A3-Advanced Automotive Antennas, Barcelona (ES)

( * ) Notice: Subject to any disclaimer, the term of this patent is extended or adjusted under 35 U.S.C. 154(b) by 751 days.

(21) Appl. No.: 11/721,312

(22) PCT Filed: Dec. 8, 2005

(86) PCT No.: PCT/EP2005/013144

§ 371 (c)(1),
(2), (4) Date: Jun. 8, 2007

(87) PCT Pub. No.: WO2006/061218

PCT Pub. Date: Jun. 15, 2006

(65) Prior Publication Data

US 2009/0237313 A1 Sep. 24, 2009

Related U.S. Application Data

(60) Provisional application No. 60/634,804, filed on Dec. 9, 2004.

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS

| | | | | |
|---|---|---|---|---|
| 6,140,975 | A | 10/2000 | Cohen | |
| 6,452,553 | B1 * | 9/2002 | Cohen | 343/702 |
| 6,552,690 | B2 * | 4/2003 | Veerasamy | 343/713 |
| 7,421,321 | B2 * | 9/2008 | Breed et al. | 701/29 |
| 7,492,270 | B2 * | 2/2009 | Veerasamy | 340/602 |
| 7,675,470 | B2 * | 3/2010 | Sanz et al. | 343/702 |
| 2002/0105468 | A1 * | 8/2002 | Tessier et al. | 343/713 |
| 2004/0119644 | A1 * | 6/2004 | Puente-Baliarda et al. | 343/700 MS |
| 2008/0018544 | A1 * | 1/2008 | Rozan | 343/713 |

FOREIGN PATENT DOCUMENTS

| | | | |
|---|---|---|---|
| EP | 1 313 166 | A1 | 5/2003 |
| WO | WO 01/54225 | A1 | 7/2001 |
| WO | WO 03/023900 | A1 | 3/2003 |

* cited by examiner

*Primary Examiner*—Huedung Mancuso
(74) *Attorney, Agent, or Firm*—Sughrue Mion, PLLC

(57) ABSTRACT

The present invention relates to a miniature antenna for a motor vehicle. The antenna may, for example, be a printed board miniature radio antenna for AM/FM signal reception. The antenna may, for example, be placed in an internal mirror of a motor vehicle or on an exterior surface of the motor vehicle, such as the vehicle's roof. The antenna is shaped as a curve of conductive material in which the geometry of at least a part of said curve comprises a space-filling curve or a grid dimension curve.

37 Claims, 15 Drawing Sheets

MINIATURE ANTENNA FOR A MOTOR VEHICLE

OBJECT OF THE INVENTION

The technology described in this patent document relates generally to a miniature antenna for a motor vehicle. The antenna may, for example, be a printed board miniature radio antenna for AM/FM signal reception. The antenna may, for example, be placed in an internal mirror of a motor vehicle or on an exterior surface of the motor vehicle, such as the vehicle's roof. In some examples, the antenna may be grouped with other antennas for wireless applications or may be included in a group of antennas to improve the signal reception.

It is one object of the present invention to provide miniature antennas that can be fitted inside a component of the vehicle or that can be mounted on the external surface of a vehicle.

BACKGROUND OF THE INVENTION

Until recently, the telecommunication services included in an automobile were limited to a few systems, mainly the analogical radio reception (AM/FM bands). The most common solution for these systems is the typical whip antenna mounted on the car roof. The current tendency in the automotive sector is to reduce the aesthetic and aerodynamic impact of such whip antennas by embedding the antenna system in the vehicle structure. Also, a major integration of the several telecommunication services into a single antenna is specially attractive to reduce the manufacturing costs or the damages due to vandalism and car wash systems.

SUMMARY OF THE INVENTION

One aspect of the invention refers to an antenna system for motor vehicles which comprises at least one antenna shaped as a curve of conductive material, wherein the geometry of at least a part of said curve comprises a space-filling curve or a grid dimension curve, said curve having preferably a box-counting dimension or grid dimension larger than 1.5.

In the antenna system the antennas are preferably small antennas so that the antennas can be fitted or enclosed within an sphere having a radius smaller than $\lambda/2\pi$, wherein $\lambda$ is the free space operating wavelength.

In another aspect of the invention the antenna system comprises at least two electrically small antennas connected to a combiner unit which is adapted to add in amplitude, phase or frequency signals received from the antennas. The combiner unit acts as a microwave power divider with an equal power division to each antenna connected but with an unequal phase division to each antenna connected. Each antenna connected to the combiner unit is adapted to receive in different sub-bands of the total bandwidth so that adding in frequency all the signals coming from the antennas, the total antenna's bandwidth it's obtained Example applications for the antenna disclosed herein may include broadcast station radio reception in the AM (LW: 150 kHz-279 kHz and MW: 530 kHz-1710 kHz) Japan and European FM band (78 MHz-108 MHz). Other example applications may include service for GSM900, GSM1800, GPS, DAB, DTB, PCS1900, KPCS, CDMA, WCDMA, TDMA, UMTS, TACS, ETACS, SDARS, WiFi, WiMAX, UWB, Bluetooth, or ZigBee.

Placing the antenna in an internal mirror of the motor vehicle, such as a rear-view mirror, may enhance the aesthetics of the vehicle, provide less opportunity to steal the antenna, and provide other advantages. Attaching the antenna to the roof of the motor vehicle may also provide advantages, such as enhancing the aesthetics of the vehicle, avoiding damage suffered by a conventional car antenna, providing a compact antenna solution with less possibility of being stolen, and other advantages.

Some example features of the antenna described herein may include:

- Implementation in a robust electrical substrate or dielectric support to help ensure the correct position and viability of the different metallic parts of the antenna.
- Placement in a remote position with a specific connection to the vehicle's ground or to the physical support for the antenna with connections to the vehicle's ground.
- A plastic antenna housing to help ensure waterproof protection of the antenna board and active system components, fixation and position of the antenna in the car.
- The capacity to integrate another antennas services into the same space.

A further aspect of the invention refers to a motor vehicle or to a vehicle's component, having at least one antenna system as the one previously described.

BRIEF DESCRIPTION OF THE DRAWINGS

To complete the description and in order to provide for a better understanding of the invention, a set of drawings is provided. Said drawings form an integral part of the description and illustrate a preferred embodiment of the invention, which should not be interpreted as restricting the scope of the invention, but just as an example of how the invention can be embodied. The drawings comprise the following figures.

DESCRIPTION OF THE PREFERRED EMBODIMENT OF THE INVENTION

Figure 1:
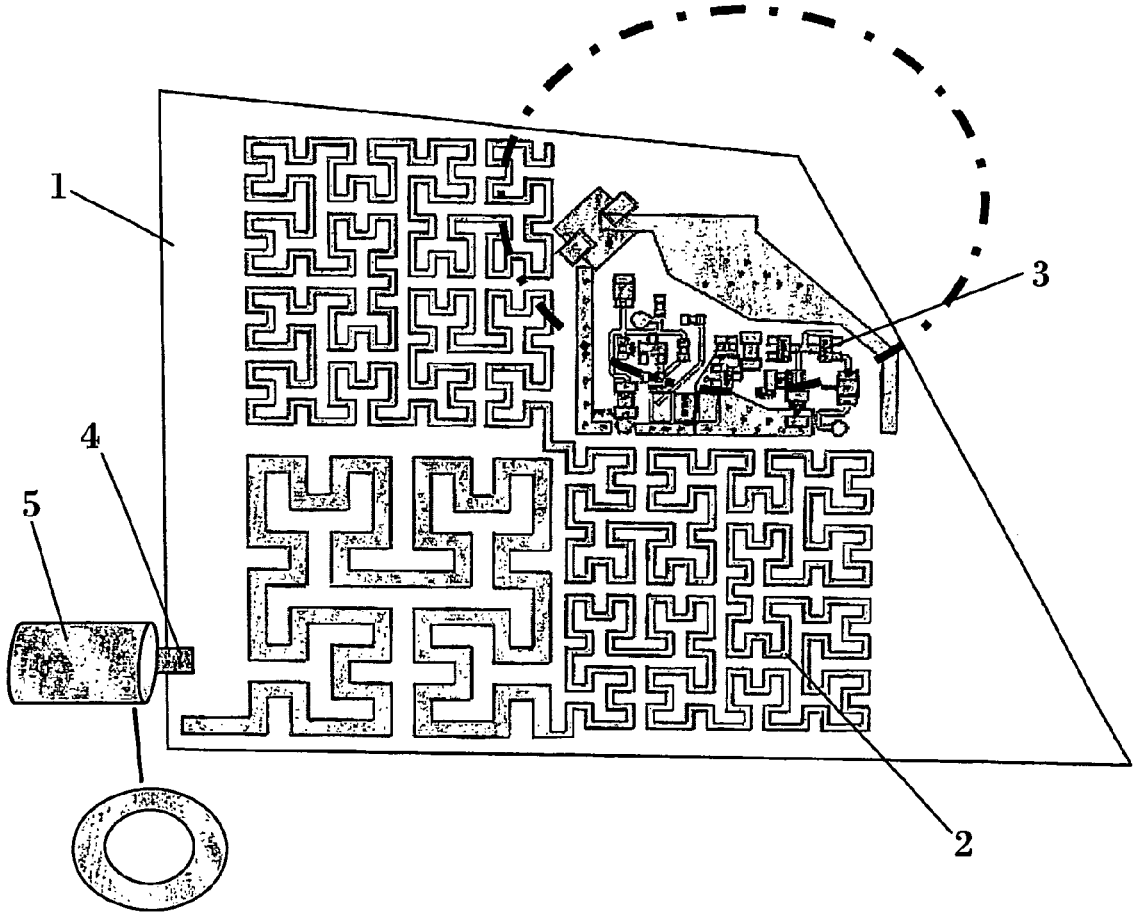
FIG. 1.—shows a schematic side view of an example of a miniature antenna system for a motor vehicle.

FIG. 1 shows an antenna system according to one embodiment of the present invention, which includes an electric substrate (1), an antenna curve (2), an AM/FM active module (3), a ground point connection (4), and a coaxial output (5). The electrical substrate (1) of FIG. 1 may be a robust electrical substrate or dielectric support that helps to ensure the correct position and viability of the different metallic parts of the antenna. The antenna curve (2) of FIG. 1 is a conductive trace that includes a space-filling, grid-dimension curve and/or has a desired box counting dimension, as described below. The geometry of the antenna curve may, for example, include a Hilbert curve based design, as it is the case of FIG. 1.

The whole antenna curve or at least a portion of it may preferably have a box-counting dimension or grid dimension larger than 1.5. In general, the higher the box-counting or grid dimension, the higher the antenna size compression. In some cases, it has been found in the present invention that an antenna including a curve with a dimension larger than 1.7 or 1.9 may be preferred because it provides an advantageous performance for this particular use. In addition, the antenna curve may be optimized for FM/AM reception.

The AM/FM active module (3) of FIG. 1 may be a printed circuit board (PCB) with SMD components of FM and AM amplifier stages, that is the active module (1) comprises an electronic amplifier circuit. The AM/FM active module may, for example, be implemented using a robust and low-cost substrate amplifier attached to the same PCB as the antenna curve. The ground point connection (4) of FIG. 1 may be a metallic ring. The ground point connection may help ensure the correct connection of the amplifier's ground to the motor vehicle.

The output coaxial (5) of FIG. 1 may be an RF coaxial that connects the antenna to the vehicle's radio system.

In the embodiment of FIG. 1, the antenna curve (2) includes at least two parts or portions having different box-counting dimension or different grid-dimension, in order to improve the efficiency of the radiation of the antenna. Each portion have not to be equal in physical dimensions and could be placed in different positions of the antenna geometry.

Figure 2:
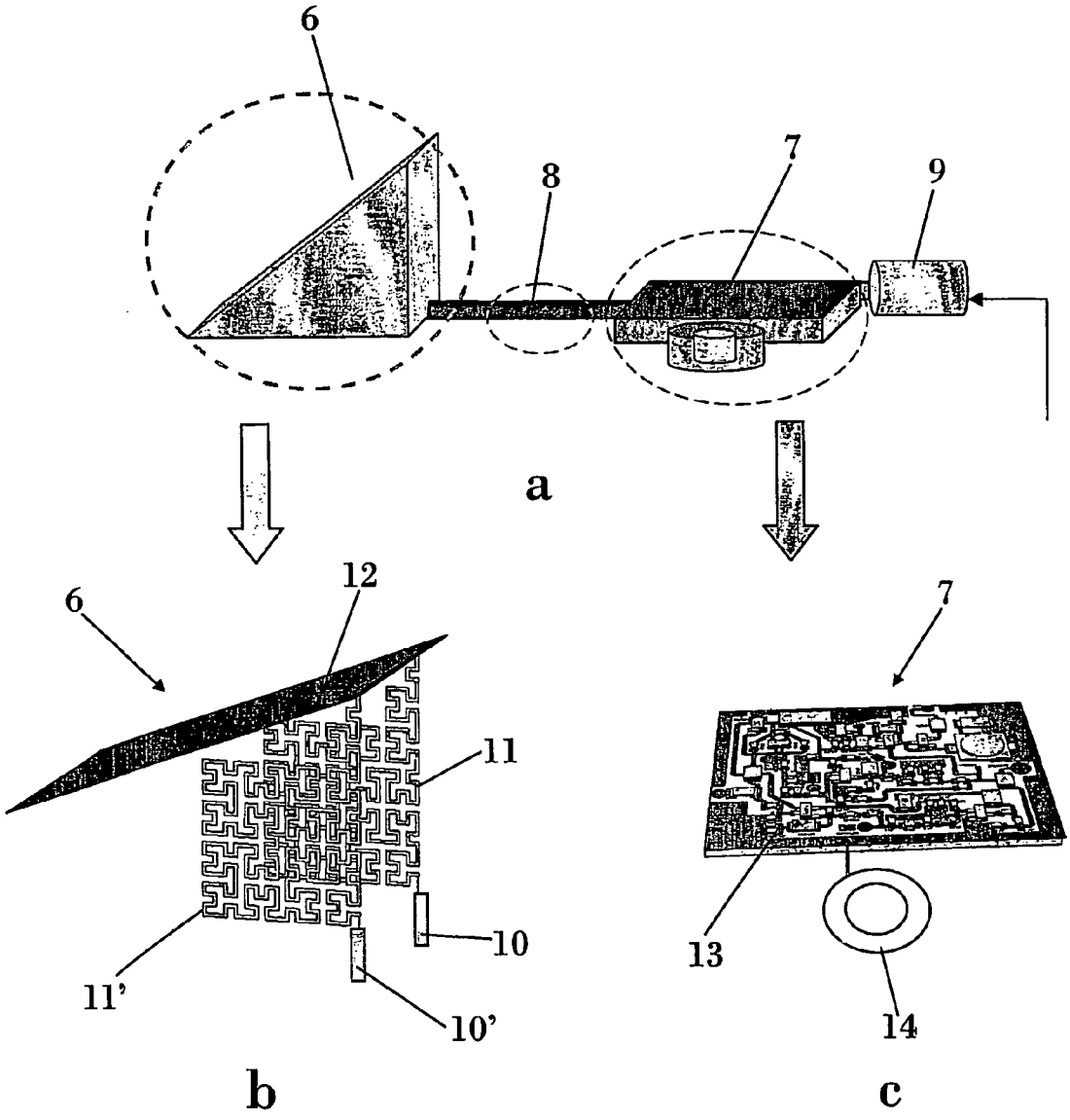
FIG. 2.—shows in figure (a) a schematic perspective view of a second example of a miniature antenna system for a motor vehicle. Figure (b) shows a more detailed view of the radiating element, and figure (c) shows in detail the active module.

The example of FIG. 2 is similar to the antenna shown in FIG. 1, except that the example of FIG. 2 includes reactive loads, a folded antenna structure and an amplifier that is separated from the antenna curve. Illustrated in FIG. 2*a* are a miniature AM/FM radiating antenna element (6), an AM/FM active module (7), and a wire connection (8) coupling the antenna element (6) to the active module (7) and a coaxial cable (9). A more-detailed illustration of the miniature FM/AM radiating antenna element (6) is illustrated in FIG. 2*b*. A more-detailed illustration of the AM/FM active module (7) is illustrated in FIG. 2*c*.

FIG. 2*b* shows the miniature FM/AM radiant element (7) which includes a first low-loss inductor (10'), a first antenna element (11'), a metallic conductor (12), a second antenna element (11), and a second low-loss inductor (10). The first and second low-loss inductors (10',10) both have a high Q value to tune the antenna to the correct frequency, wherein Q is defined as the relation between the imaginary and real part of the inductor's impedance (Q=XL/RL).

In the embodiment of FIG. 2*b*, the antenna system comprises at least two antennas (11,11'), wherein each antenna is laying on an imaginary plane, the planes being substantially parallel and spaced from each other at a selected distance. In this example the antennas have substantially the same geometric shape, in particular the antennas have a Hilbert based design. The metallic conductor (12) is placed in an inclined position with respect to the antenna elements (11,11').

The first antenna element (11')) includes an antenna structure that forms a space-filling, grid-dimension curve and/or has a desired box counting dimension, as described below. The antenna geometry may include a Hilbert curve based design. Preferably, the antenna structure forms a curve with a box-counting dimension or grid dimension larger than 1.5. In general, the higher the box-counting or grid dimension, the higher the antenna size compression. In some cases, an antenna including a curve with a dimension larger than 1.9 may be more preferred. The space filling or grid-dimension curve may be optimized for FM/AM reception.

The metallic conductor (12) is coupled to the of the antenna structure formed by antenna elements (11,11'), and generates a capacitive load. The metallic conductor (12) may help to provide a good balance between the antenna's bandwidth, efficiency and dimensions. The capacitive effect may also be achieved using the PCB, for instance a capacitor element may be printed on the printed circuit board (PCB) of the antenna.

The second antenna element (11) includes an antenna structure that includes a space-filling, grid-dimension curve and/or has a desired box counting dimension, as described below. The antenna geometry is structured to achieve an input impedance of about 50 Ohms at the input of the radio receptors in the FM band. In other examples, more than two antenna elements or PCBs provided with antenna structures shaped as space-filling or grid-dimension curves, may be used to help ensure the antenna's output impedance at 50 Ohms.

With reference to FIG. 2*c*, the AM/FM active module (7) includes a PCB (13) and a ground point connection (14), that can consist for instance in a metallic ring. The PCB (13) may include the SMD components of FM and AM amplifier stages. The PCB (13) may be implemented on a robust and low-cost substrate, for instance FR4. In some examples, the active module (7) comprising an amplifier circuit may be included on the same PCB as the antenna elements (11) or (11'), particularly if the mounting requirements prevent the AM/FM active module (7) from being mounted as a remote unit. The ground connection (14) is coupled to the vehicle's ground. Similarly one of the antenna elements (11,11') may be short-circuited to the car's electric ground.

Figure 3:
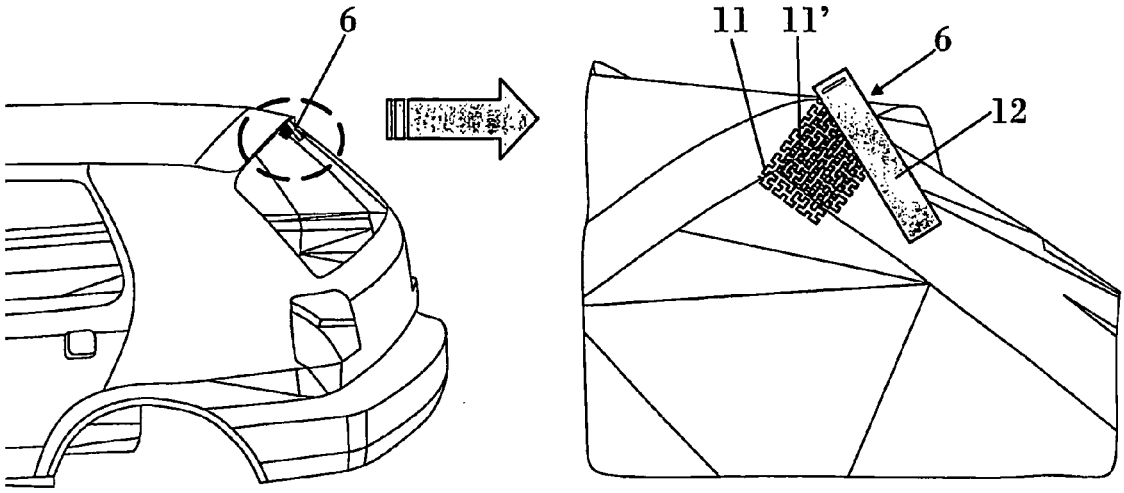
FIG. 3.—shows an example of a miniature AM/FM antenna assembly located at a back edge of the vehicle's frame. At the right side of the figure is an enlarged detail of the antenna assembly.
Figure 4:
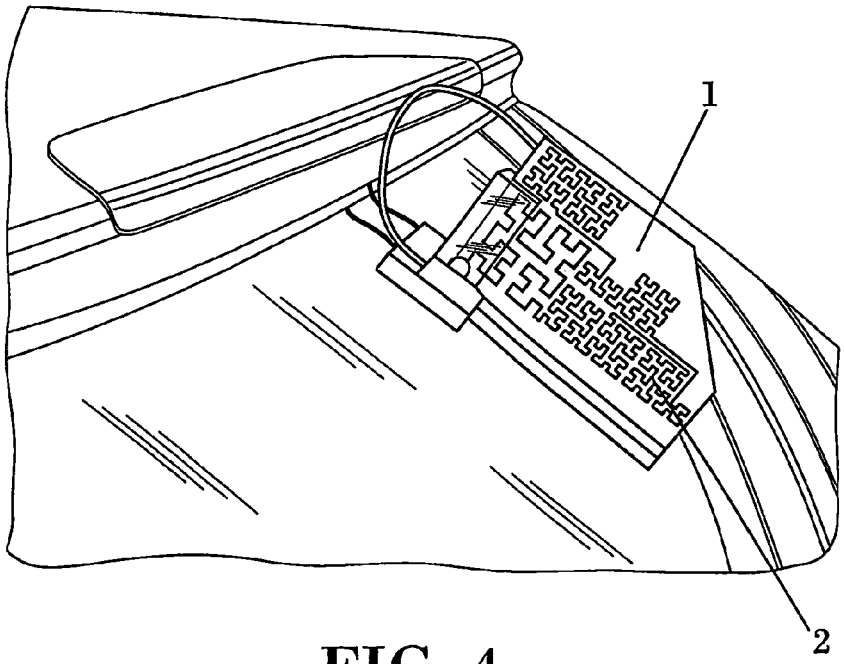
FIG. 4.—shows another example of a miniature AM/FM antenna assembly installed at the back windscreen of a motor vehicle.
Figure 5:
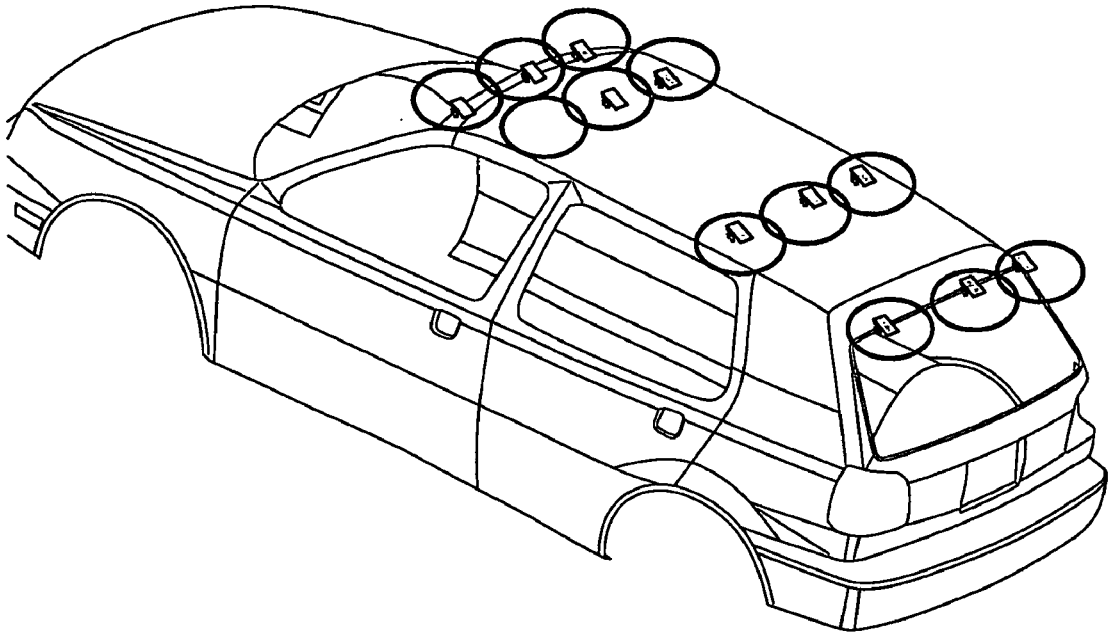
FIG. 5.—shows several examples of additional positions in which a miniature AM/FM antenna assembly may be installed on the roof or front windshield of a motor vehicle.

With reference again to FIG. 2*a*, the wire connection (8) may, for example, be a coaxial cable, a single wire, or some other type of suitable device for electrically connecting the radiating antenna element (6) to the AM/FM active module (7). The wire connection (8) forms part of the antenna and it is designed to optimize the performance of the antenna system. If the length of the wire is increased the antenna's resonant frequency is reduced, on the other hand, if the length of the wire is decreased the antenna's resonant frequency is increased. Therefore, the wire connection it's useful to do an adjustment of the antenna's resonant frequency Antenna Installation In addition to being mounted in an internal mirror, the miniature AM/FM antenna assembly described herein may be mounted at different locations on the external surface a motor vehicle. FIGS. 3, 4 and 5 provide several examples for mounting the AM/FM antenna assembly on an external surface of a motor vehicle.

Thereby, another aspect of the invention refers to a motor vehicle provided with the antenna system previously described. In the motor vehicle antenna system comprising miniature antennas, is installed at the exterior surface of the vehicle next to vertexes and ends of the vehicle, as shown in FIGS. 3, 4 and 5, where it has been found that performance of the miniature antenna is improved. For example, the antenna system may be mounted on the back windscreen or on the front windscreen or on the ceiling of the motor vehicle. Preferably, the antenna system is housed within a non-conductive cover and it is mounted on the vehicle by means of this cover or housing. Alternatively, the antenna system is housed within a rear-view mirror of the motor vehicle.

The antenna system is installed at a selected position of the exterior surface of a car far away form electronic interferences and other EMC problems to increase the subjective audio quality reception.

Antenna Dimensions

In one preferred embodiment, the maximum dimensions of the miniature antenna may be fixed by the Wheeler criteria. The Wheeler criteria defines an electrically small antenna as one having a maximum dimension that is less than $$\left(\frac{\lambda}{2\pi}\right).$$

This relation my be expressed as: $ka<1$, where $k=2\pi/\lambda$ (radians/meter); $\lambda$=free space wavelength (meters); and a=radius of sphere enclosing the maximum dimension of the antenna (meters). By choosing a high box-counting or grid-dimension for at least a portion of the curve shaping the antenna (for instance higher than 1.5, higher than 1.7 or higher than 1.9), a higher size compression can be achieved. In some embodiments, as the one shown in FIG. 6 the antenna fits inside a sphere with a radius (a) smaller than $\lambda/10$, smaller than $\lambda/20$ or even smaller than $\lambda/40$ at the center of the FM band or other radio or wireless service.

It has been established that for an electrically small antenna, contained within a given volume, the antenna has an inherent minimum value of. This places a limit on the attainable impedance bandwidth of an Electrically Small Antenna. For a miniature antenna in the FM band where $\lambda$ is bigger than other wireless services as GSM900, GSM1800, GPS at the same volume is expected to obtain very poor impedance bandwidth. In one example according to the present invention, this problem is resolved by combining two miniature antennas with an adequate separation between them. An example of a combined antenna system with an increased impedance bandwidth is shown in FIGS. 7 and 8.

Figure 7:
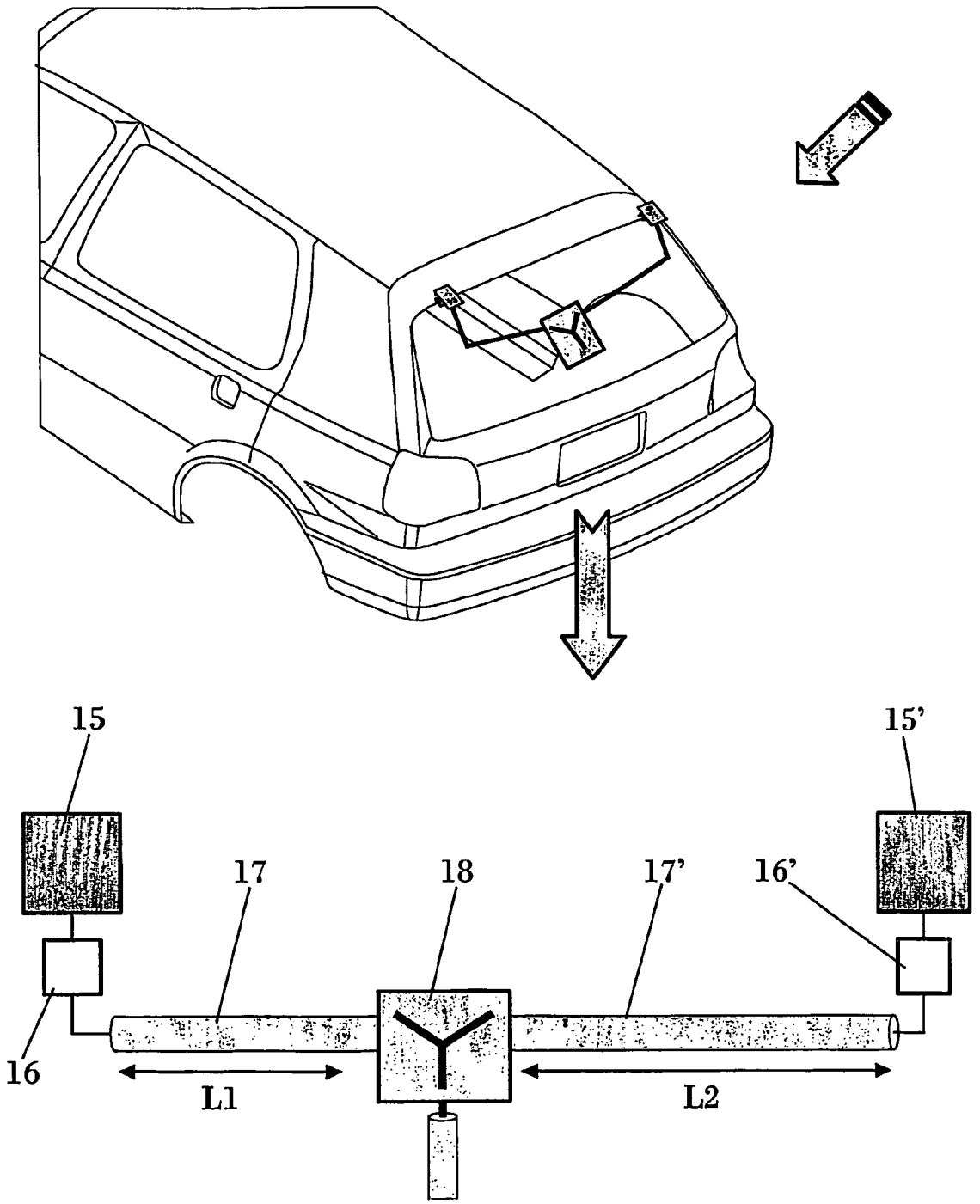
FIG. 7.—shows in figure (a) a two miniature AM/FM combined antennas mounted on a rear windscreen of a vehicle. Figure (b) is a schematic representation of the two miniature AM/FM combined antennas.
Figure 8:
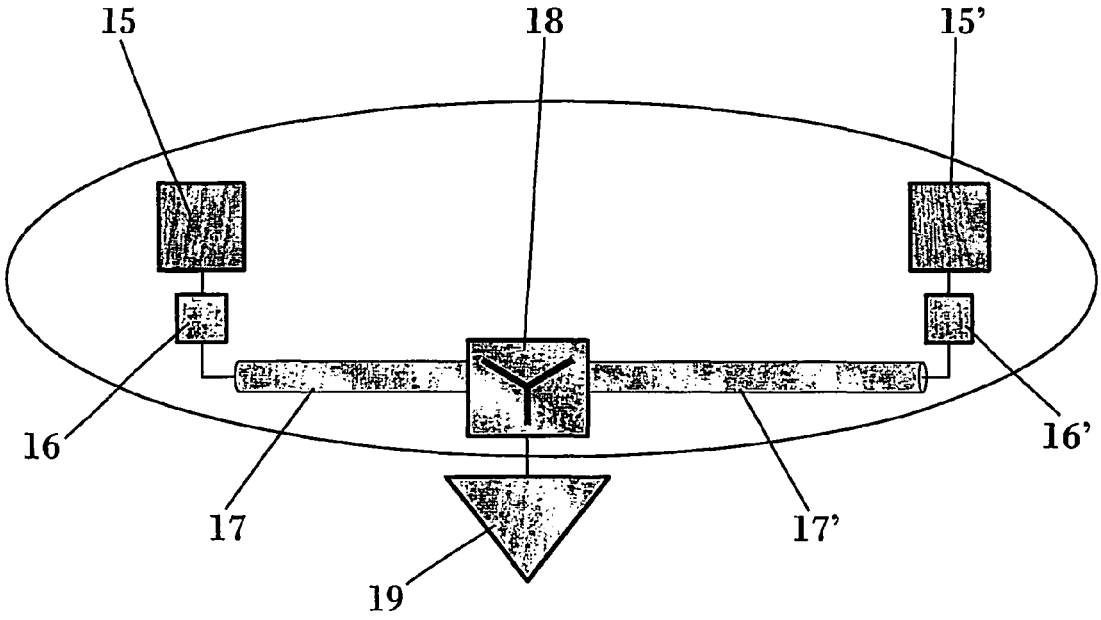
FIG. 8.—shows another schematic representation of two miniature AM/FM combined antennas and an active module.

The example combined antenna system of FIG. 7 includes two miniature FM/AM antennas (15,15'), two tunable antenna units (16,16')(B1 and B2), two coaxial connections (17,17') having L1 and L2 lengths respectively, and an antenna combiner unit (18). It should be noted that tunable units are passive circuits designed with lumped elements specially selected to adjust the antenna's self-resonant frequency. The miniature FM/AM antennas (15,15') may be two radiant antenna elements that form a space-filling, grid-dimension curve and/or has a desired box counting dimension, as described below. The tuning antenna units (16,16') may be operable to help ensure that the two electrically small antennas or miniature antennas are working in FM/AM bands. The coaxial connections (17,17') may be two lengths of RF coaxial (L1 and L2) that connect the two Tuning antenna units to the Antenna combiner unit. The lengths L1 and L2 may be different to provide an unequal phase division.

The antenna combiner unit (18) may be a perfect or substantially perfect 50 Ohms matched unit to help ensure the correct addition of the two complex signals coming from the two antennas. The combiner unit (18) is adapted to add in amplitude, phase or frequency signals received from the antennas. The combiner unit acts as a microwave power divider with an equal power division to each antenna connected but with an unequal phase division to each antenna connected. The equal power division could be done with distributed Tx lines of $\lambda/4$ dimension, transformers or microwave components suitable for this function. Whereas, the unequal phase division could be performed by reactive elements, microwave components or doing unequal the length (L1,L2) of the Tx lines which connect the antenna systems to the combiner unit.

Figure 17:
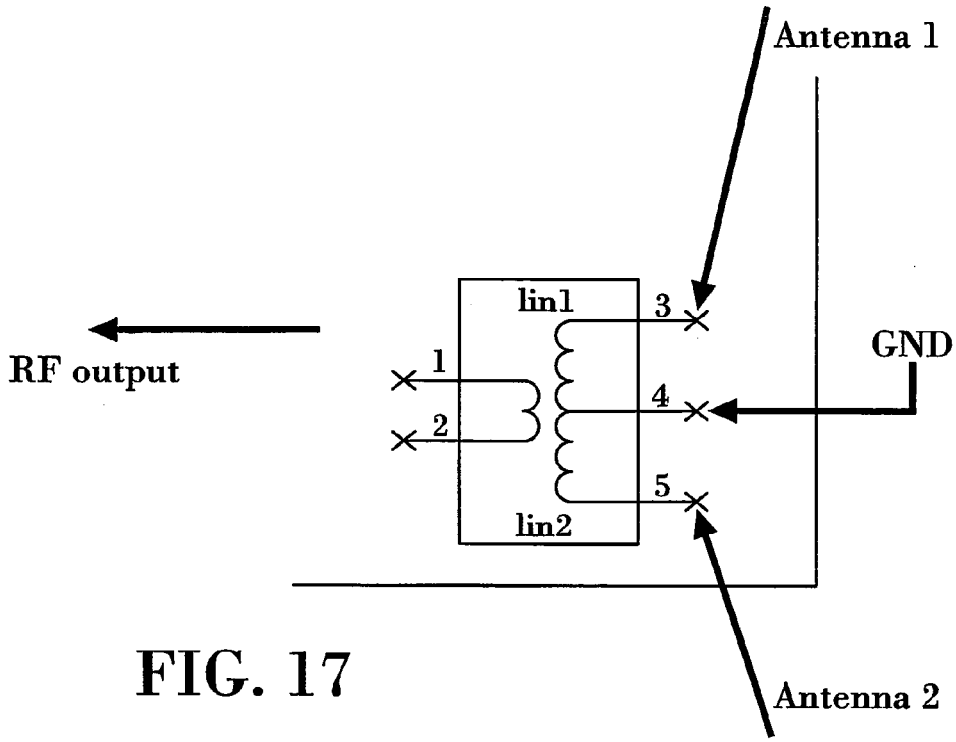
FIG. 17.—shows an example of a combiner unit for HF and VHF applications.
Figure 18:
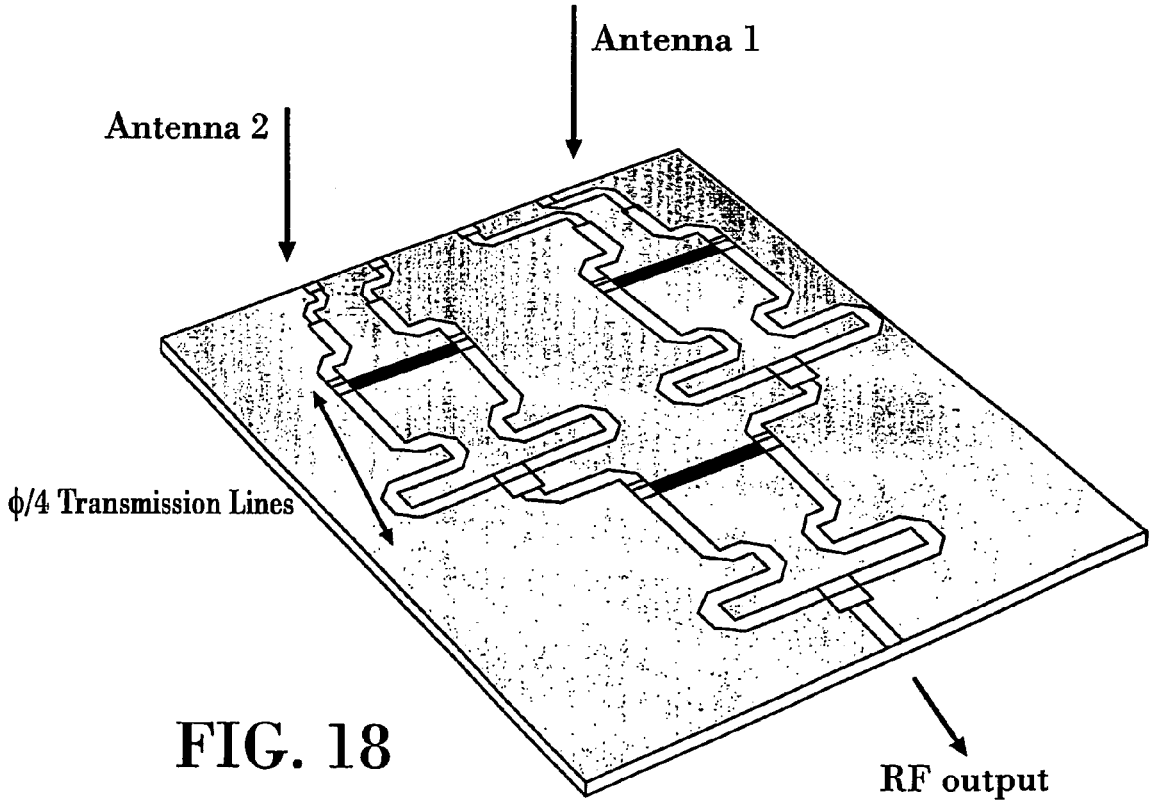
FIG. 18.—shows an example of a combiner unit for UHF applications.
Figure 19:
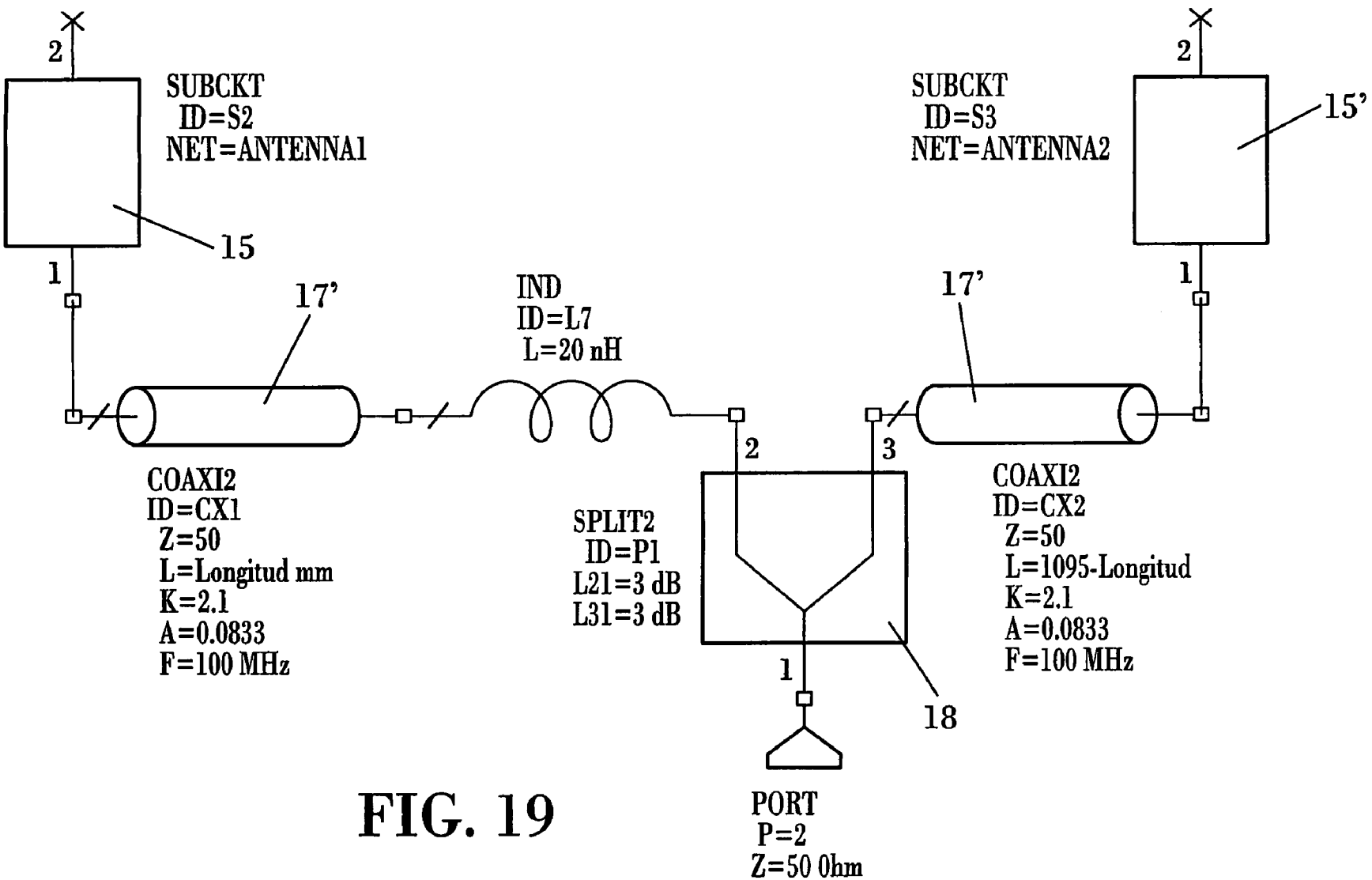
FIG. 19.—shows another example of a combiner unit.

The physical implementation of the combiner unit may be performed in different ways depending of the frequency design. In HF and VHF applications the most suitable implementation of the unit is done by a SMD transformer as shown in FIG. 17, wherein the signals of antennas 1 and 2 are combined in the transformer to provide a RF output. In UHF or upper bands the combiner could be implemented by transmission lines as shown for instance in FIG. 18. The transmission lines may have an electric length of $\lambda/4$. A further example of combiner unit is shown in FIG. 19, wherein an inductor is connected between the coaxial cable (17) and the combiner unit (18).

In the antenna system each miniature antenna is adapted to receive signals in different sub-bands of a total desired bandwidth, so that by adding in frequency with the combiner unit, all the signals coming from both miniature antennas, the desired total antenna's bandwidth of a single bigger non-miniature antenna, is obtained or simulated.

The combiner unit acts as a microwave diplexer which adds signals in frequency with and equal module and phase. This feature of frequency addition could be performed by Tx lines, filters or microwave components suitable for this function.

Figure 6:
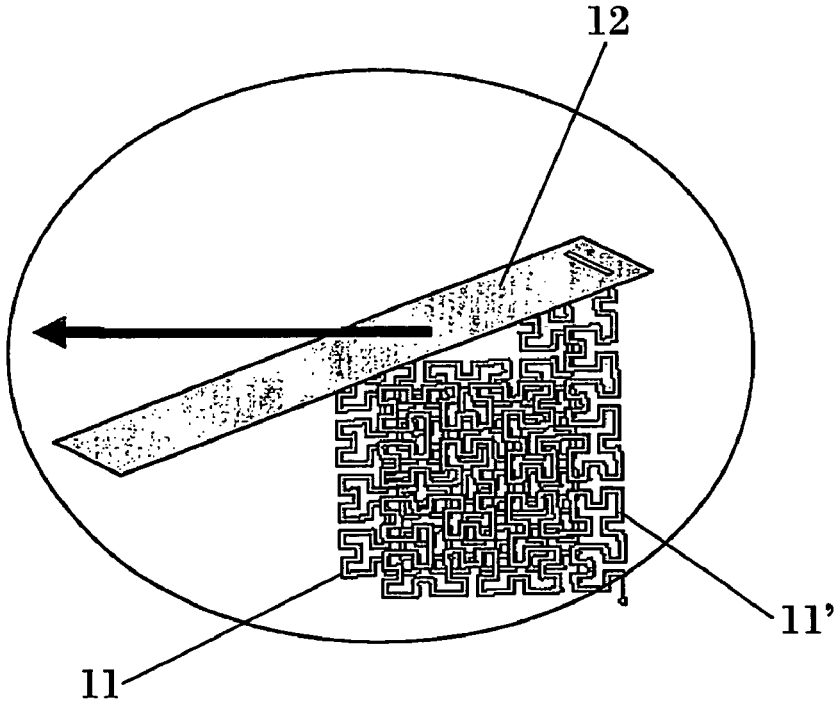
FIG. 6.—shows an example miniature antenna with a maximum dimension of 50 cm, according to the Wheeler criteria. An sphere is represented by the closed line.

The antenna system represented in FIG. 6, may be used in a diversity system which in a known manner selects the better group of antennas in each moment for the reception of signals. The two combined antennas of FIG. 6 may be used in a diversity system in combination with a second couple of antennas, so that be means of an electronic circuit and while the vehicle is moving, the diversity system improve the quality of the received audio signal, for instance by choosing the couple of antennas having the better signal level.

Furthermore, the diversity system may adds signals coming from the antenna systems with the same phase in order to obtain the optimum performance. To adjust the phase of the different antenna systems an additional phase unit control has to be added. The phase unit control acts as a microwave component which doesn't change the amplitude of the signal coming through the coaxial but changes the phase of the signal coming through the coaxial.

In addition to the components illustrated in FIG. 7, an active module (19) may also be coupled to the antenna combined system in order to amplify the signal levels, as illustrated in FIG. 8. The active module (19) may be a PCB with the SMD components of FM and AM amplifier stages, as previously described.

Figure 9:
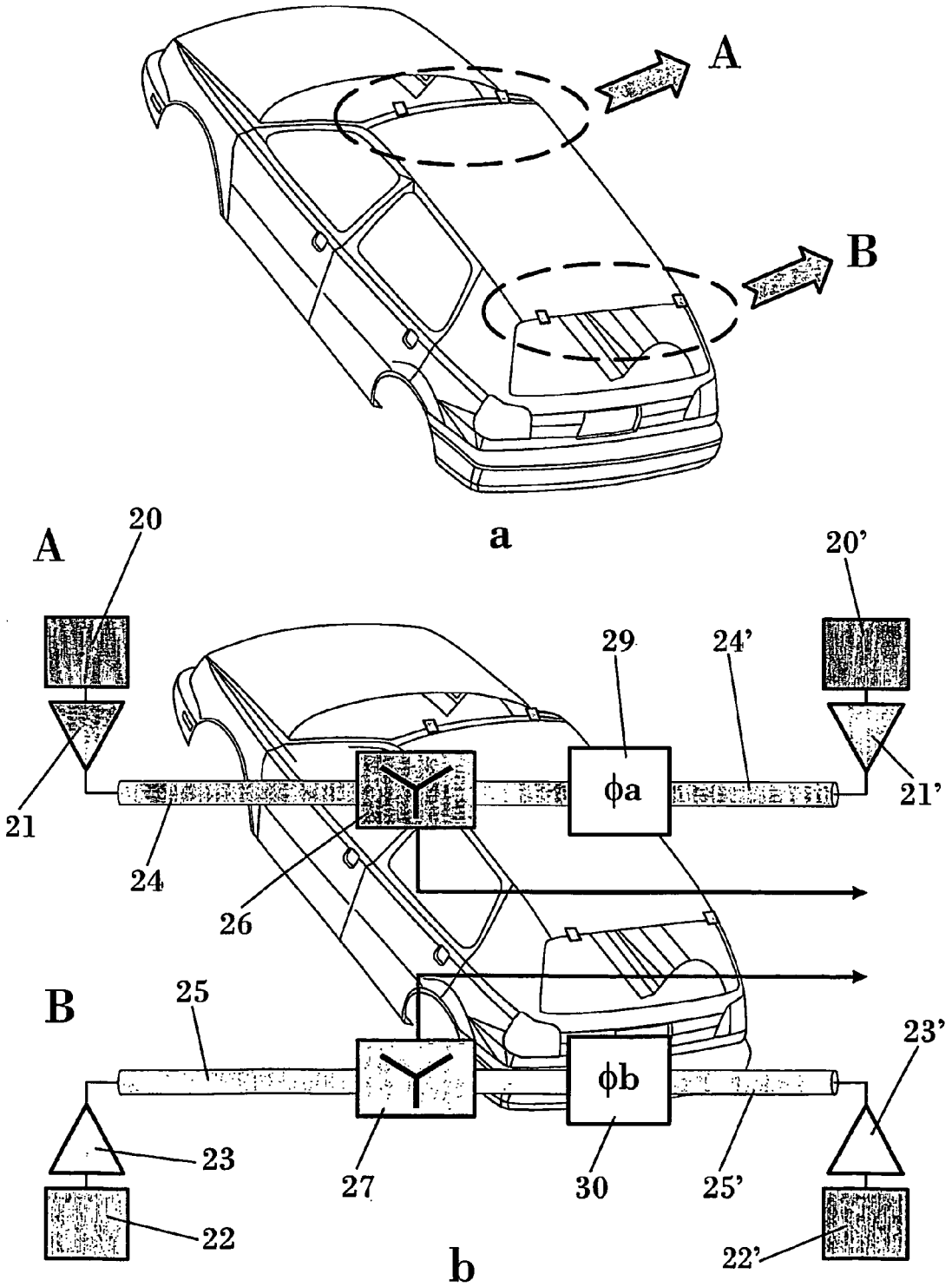
FIG. 9.—shows in figure (a) two pairs of miniature AM/FM combined antennas mounted on a front and rear windscreens of a vehicle. Figure (b) is a schematic representation of the two miniature AM/FM combined antennas.

A diversity antenna system may be used to improve the quality of audio reception. A miniature AM/FM antenna, as described herein, may be used to separate two or more antennas in the vehicle. FIG. 9 shows an example miniature antenna used in a diversity antenna system. The example diversity antenna system shown in FIG. 9 includes four miniature FM/AM antenna elements (20,20', 22, 22'), four active modules (21,21',23,23'), coaxial connections (24,24',25,25'), antenna combiner units (26,27), and two phase control units (29,30). The miniature FM/AM antenna elements (20,20', 22, 22') are antenna structures that form a space-filling, grid-dimension curve and/or has a desired box counting dimension, as described below. The active modules (21,21',23,23') are AM/FM active stages, as described above. The coaxial connections (24,24',25,25') may be RF coaxial coupled between the antennas in order to feed correct phase and amplitude to all of the miniature antenna elements. The antenna combiner units (26,27) are operable to help ensure the correct addition of the signals becoming from all of the antennas. Preferably, the antenna combiner units (26,27) ensure a perfect 0° signal combine. The phase control units (29,30) help to ensure the correct decorrelation between the two groups of miniature antennas (20,20', 22, 22') to improve performance of the diversity antenna system.

Space-Filling Curves

One or more of the antenna elements described herein may be miniaturized by shaping at least a portion of the antenna element to include a space-filling curve. FIG. 9 (below) shows examples of space-filling curves. Space-filling curves 1501 through 1514 are examples of space filling curves for antenna designs. Space-filling curves fill the surface or volume where they are located in an efficient way while keeping the linear properties of being curves. A space-filling curve is a non-periodic curve including a number of connected straight segments smaller than a fraction of the operating free-space wave length, where the segments are arranged in such a way that no adjacent and connected segments form another longer straight segment and wherein none of said segments intersect each other.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1510, 1511, 1512).

Grid-Dimension Curves

One or more of the antenna elements described herein may be miniaturized by shaping at least a portion of the antenna element as a grid-dimension curve. The grid dimension of a curve may be calculated as follows. A first grid having substantially square cells of length L1 is positioned over the geometry of the curve, such that the grid completely covers the curve. The number of cells (N1) in the first grid that enclose at least a portion of the curve are counted. Next, a second grid having square cells of length L2 is similarly positioned to completely cover the geometry of the curve, and the number of cells (N2) in the second grid that enclose at least a portion of the curve are counted. In addition, the first and second grids should be positioned within a minimum rectangular area enclosing the curve, such that no entire row or column on the perimeter of one of the grids fails to enclose at least a portion of the curve. The first grid preferably includes at least twenty-five cells, and the second grid preferably includes four times the number of cells as the first grid. Thus, the length (L2) of each square cell in the second grid should be one-half the length (L1) of each square cell in the first grid. The grid dimension (Dg) may then be calculated with the following equation:

$$Dg = -\frac{\log(N2) - \log(N1)}{\log(L2) - \log(L1)}.$$

For the purposes of this application, the term grid dimension curve is used to describe a curve geometry having a grid dimension that is greater than one (1). The larger the grid dimension, the higher the degree of miniaturization that may be achieved by the grid dimension curve in terms of an antenna operating at a specific frequency or wavelength. In addition, a grid dimension curve may, in some cases, also meet the requirements of a space-filling curve, as defined above. Therefore, for the purposes of this application a space-filling curve is one type of grid dimension curve.

Figure 10:
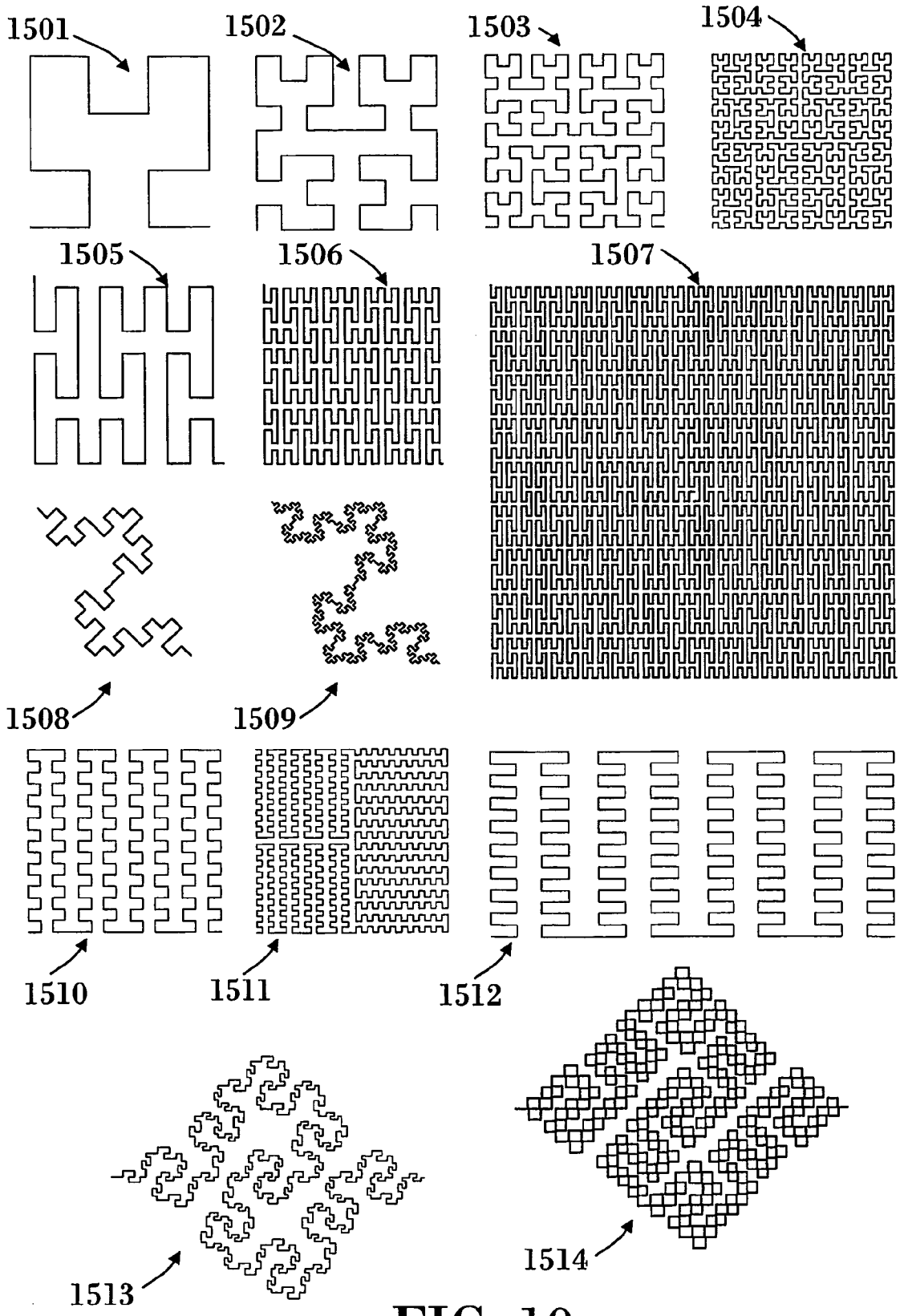
FIG. 10.—shows examples of space-filling curves.
Figure 11:
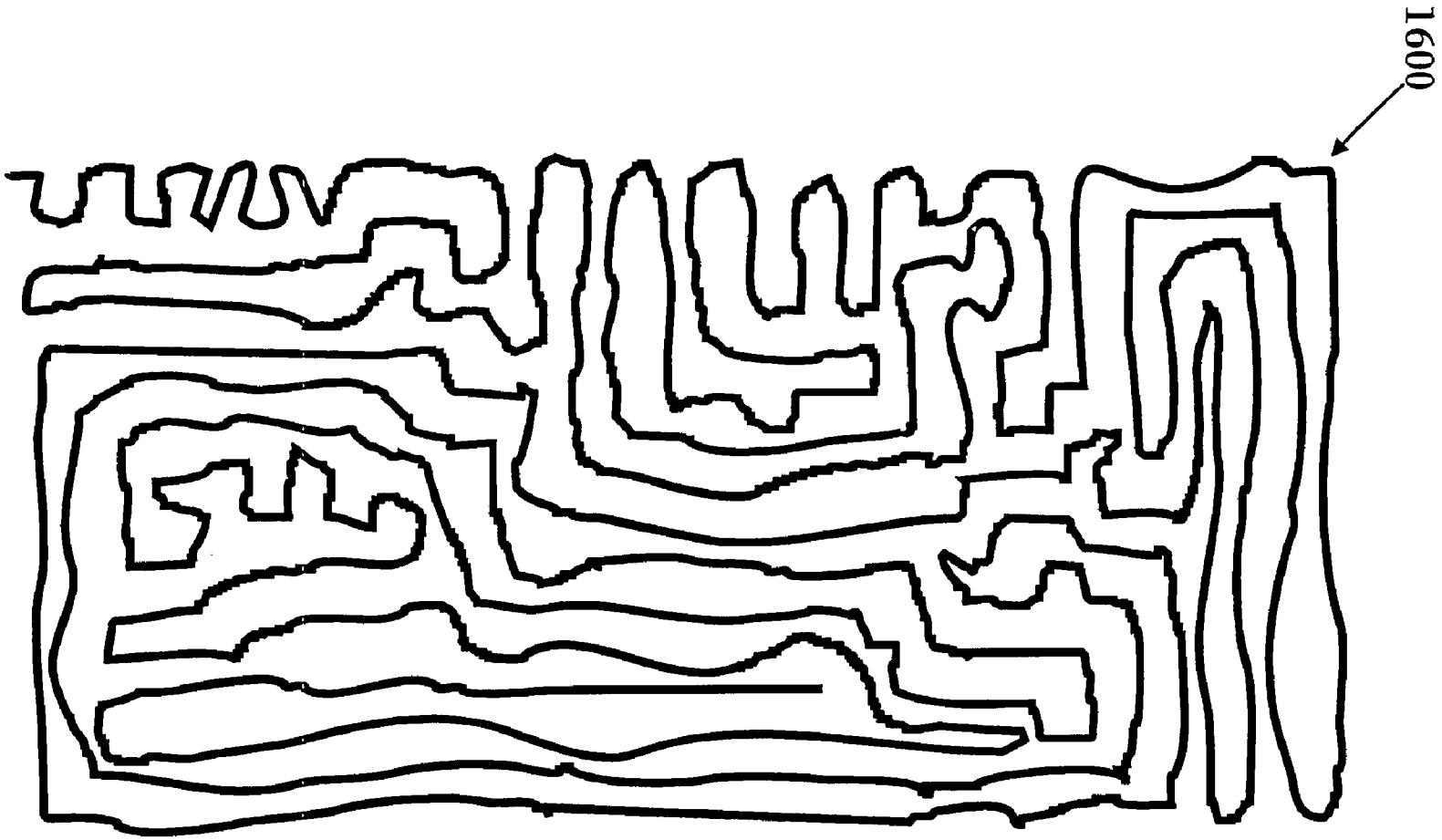
FIG. 11.—shows an example two-dimensional antenna 1600 forming a grid dimension curve with a grid dimension of approximately two (2).
Figure 12:
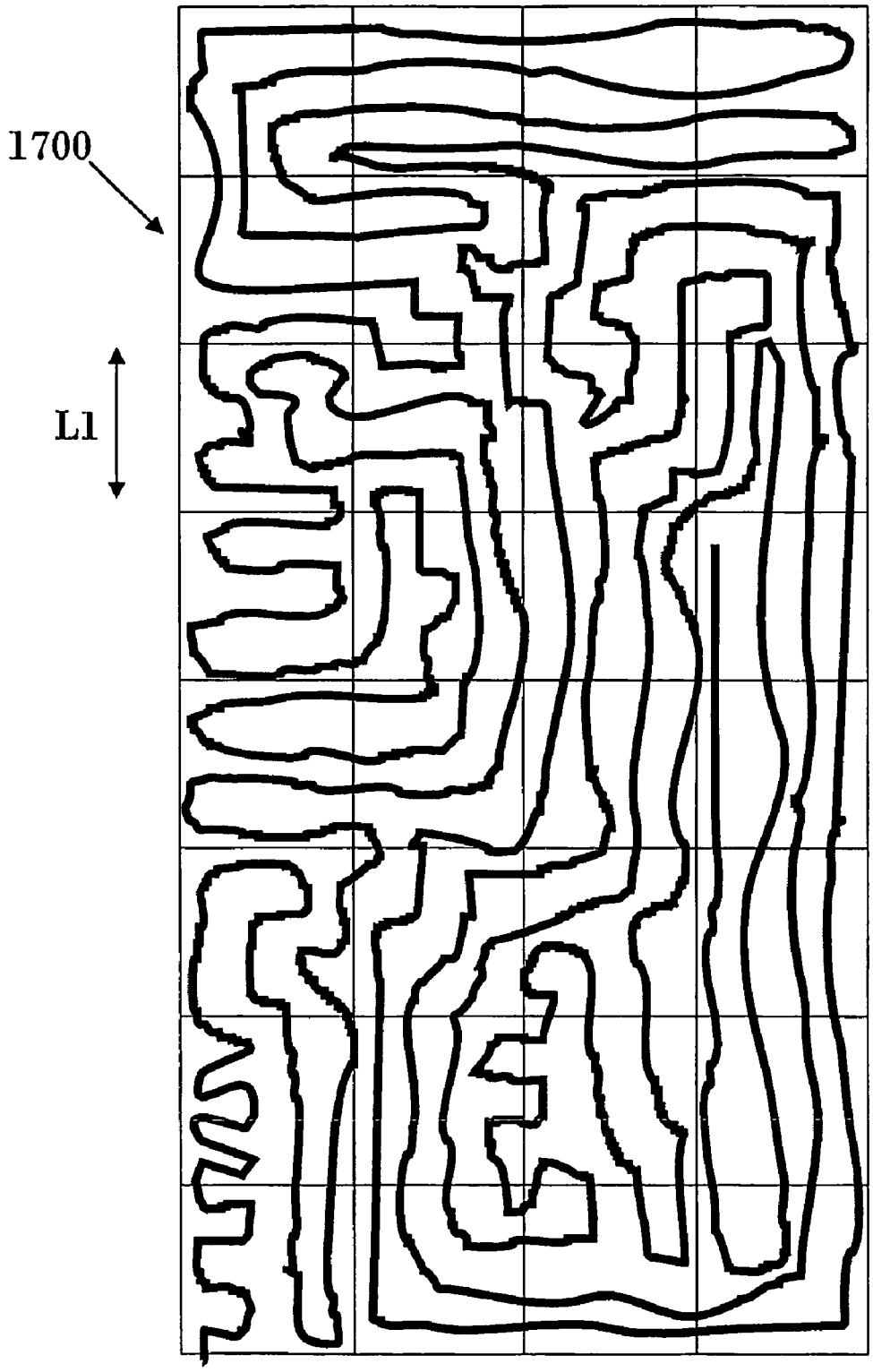
FIG. 12.—shows the antenna 1600 of FIG. 11 enclosed in a first grid 1700 having thirty-two (32) square cells, each with a length L1.

FIG. 10 (below) shows an example two-dimensional antenna 1600 forming a grid dimension curve with a grid dimension of approximately two (2). FIG. 11 (below) shows the antenna 1600 of FIG. 10 enclosed in a first grid 1700 having thirty-two (32) square cells, each with a length L1. FIG. 12 (below) shows the same antenna 1600 enclosed in a second grid 1800 having one hundred twenty-eight (128) square cells, each with a length L2. The length (L1) of each square cell in the first grid (1700) is twice the length (L2) of each square cell in the second grid 1800 (L2=2×L1). An examination of FIG. 11 and FIG. 12 reveal that at least a portion of the antenna 1600 is enclosed within every square cell in both the first and second grids 1700, 1800. Therefore, the value of N1 in the above grid dimension (Dg) equation is thirty-two (32) (i.e., the total number of cells in the first grid 801), and the value of N2 is one hundred twenty-eight (128) (i.e., the total number of cells in the second grid 802). Using the above equation, the grid dimension of the antenna 1800 may be calculated as follows:

$$Dg = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependant upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

Figure 13:
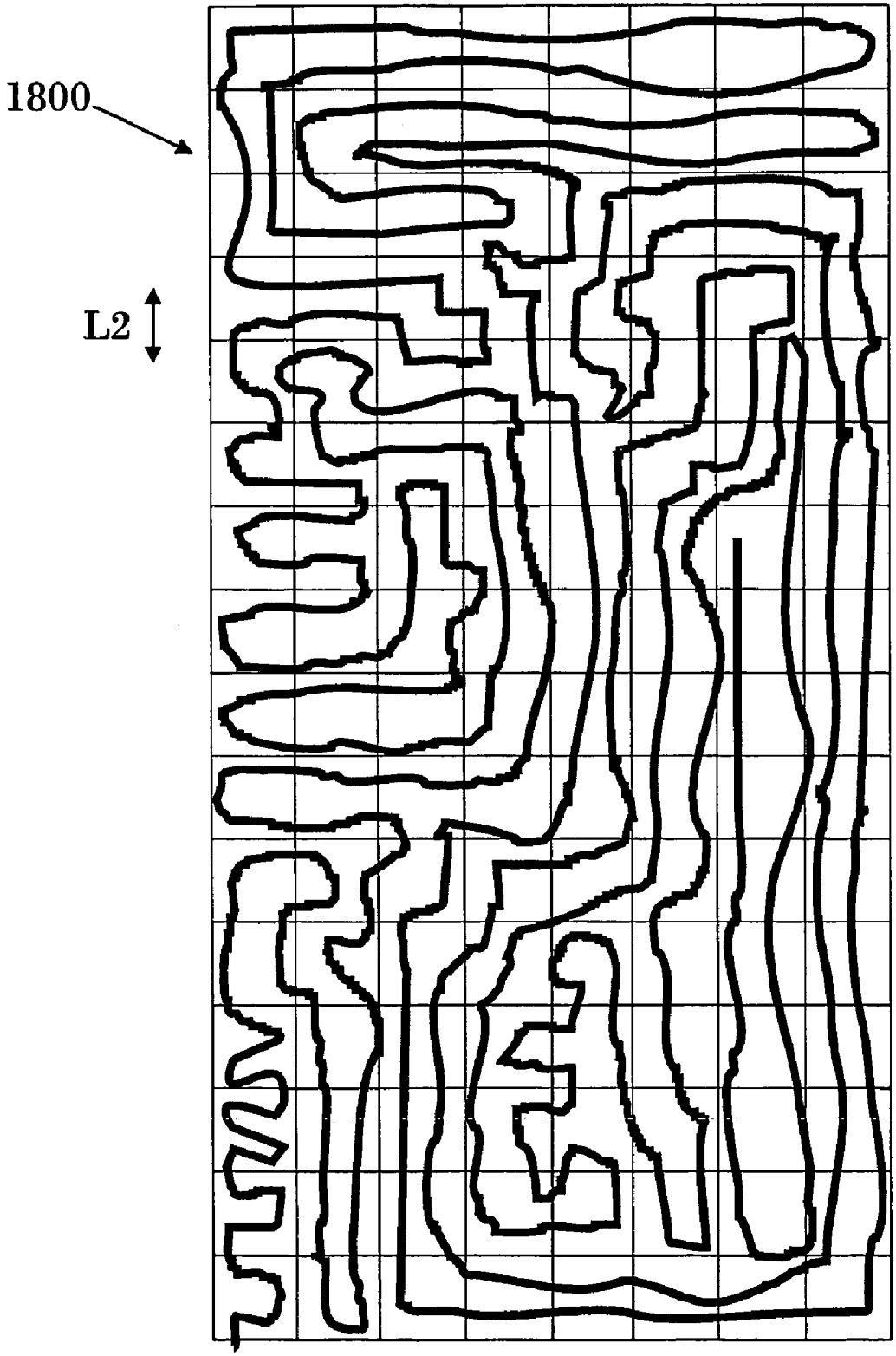
FIG. 13.—shows the same antenna 1600 enclosed in a second grid 1800 having one hundred twenty-eight (128) square cells, each with a length L2.

For example, FIG. 13 shows the same antenna 1600 enclosed in a third grid 1900 with five hundred twelve (512) square cells, each having a length L3. The length (L3) of the cells in the third grid 1900 is one half the length (L2) of the cells in the second grid 1800, shown in FIG. 12. As noted above, a portion of the antenna 1600 is enclosed within every square cell in the second grid 1800, thus the value of N for the second grid 1800 is one hundred twenty-eight (128). An examination of FIG. 13, however, reveals that the antenna is enclosed within only five hundred nine (509) of the five hundred twelve (512) cells of the third grid 1900. Therefore, the value of N for the third grid 1900 is five hundred nine (509). Using FIG. 12 and FIG. 13, a more accurate value for the grid dimension (D) of the antenna may be calculated as follows:

$$Dg = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 10).

Box Counting Dimension

One or more of the antenna elements described herein may be miniaturized by shaping at least a portion of the antenna element to have a selected box-counting dimension. For a given geometry lying on a surface, the box-counting dimension is computed as follows. First, a grid with substantially squared identical cells boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of this patent document, the box-counting dimension may be computed by placing the first and second grids inside a minimum rectangular area enclosing the conducting trace of the antenna and applying the above algorithm. The first grid should be chosen such that the rectangular area is meshed in an array of at least 5×5 boxes or cells, and the second grid should be chosen such that L2=½ L and such that the second grid includes at least 10×10 boxes. The minimum rectangular area is an area in which there is not an entire row or column on the perimeter of the grid that does not contain any piece of the curve.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve has a box-counting dimension larger than 1.1 are referred to as box-counting curves.

For very small antennas, for example antennas that fit within a rectangle having maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The grid dimension (D) may then be calculated using the above equation. In general, for a given resonant frequency of the antenna, the larger the box-counting dimension, the higher the degree of miniaturization that will be achieved by the antenna with the same wire length. One way to enhance the miniaturization capabilities of the antenna (that is, reducing size while maximizing bandwidth, efficiency and gain) is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

Figure 14:
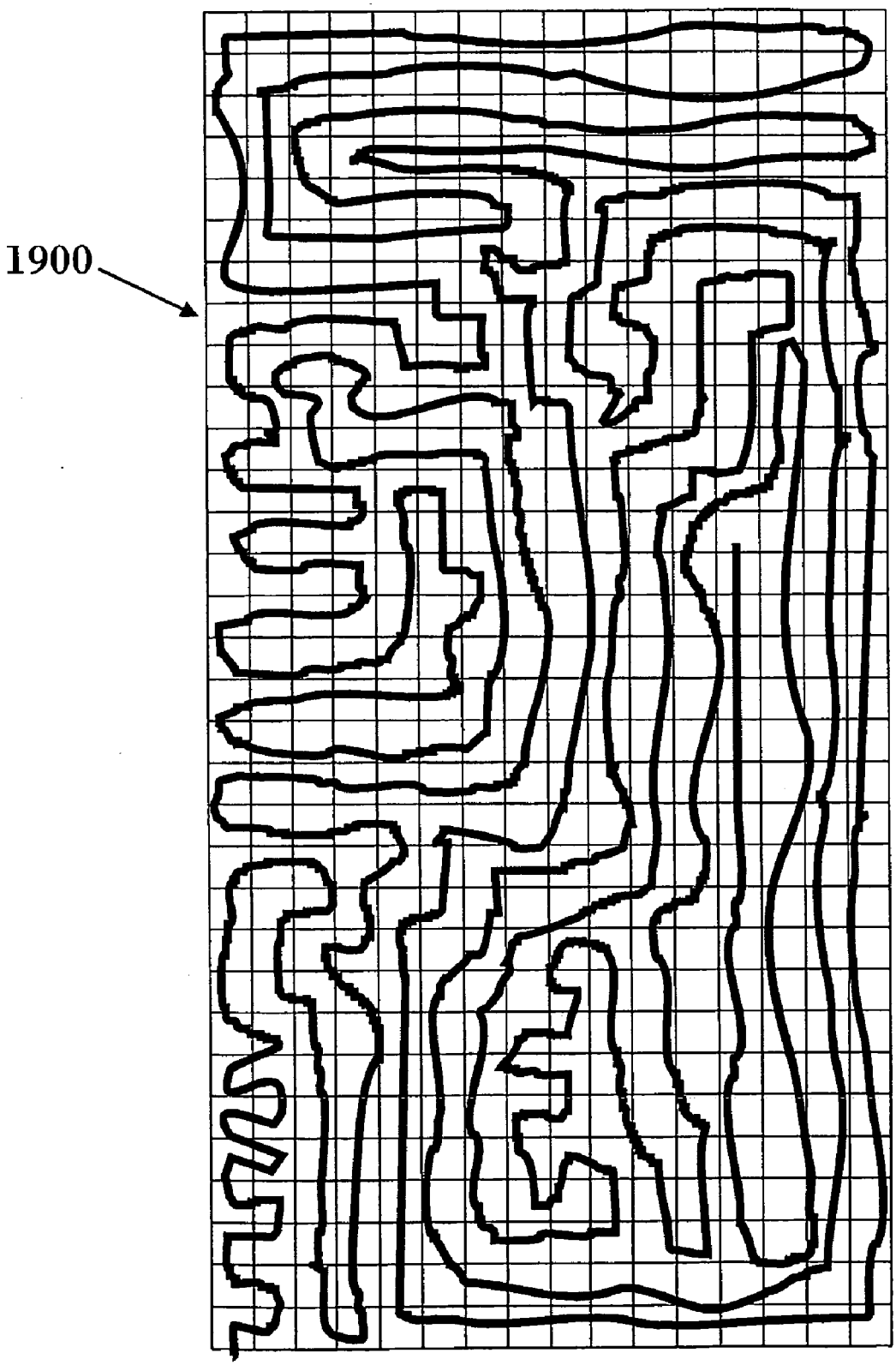
FIG. 14.—shows the same antenna 1600 enclosed in a third grid 1900 with five hundred twelve (512) square cells, each having a length L3.
Figure 15:
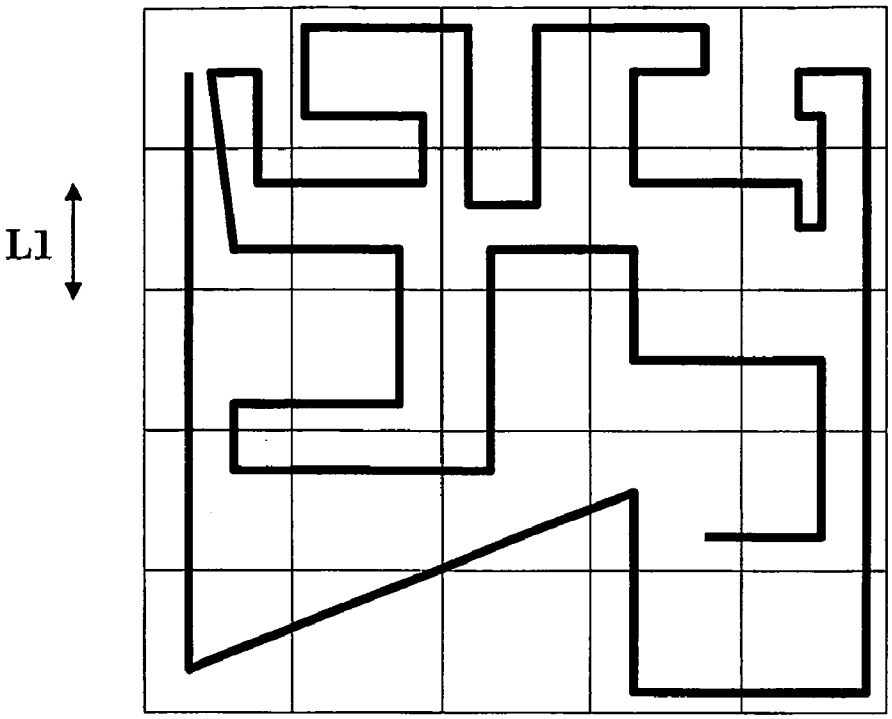
FIGS. 15 and 16.—illustrates an example of how the box-counting dimension of a curve is calculated.
Figure 16:
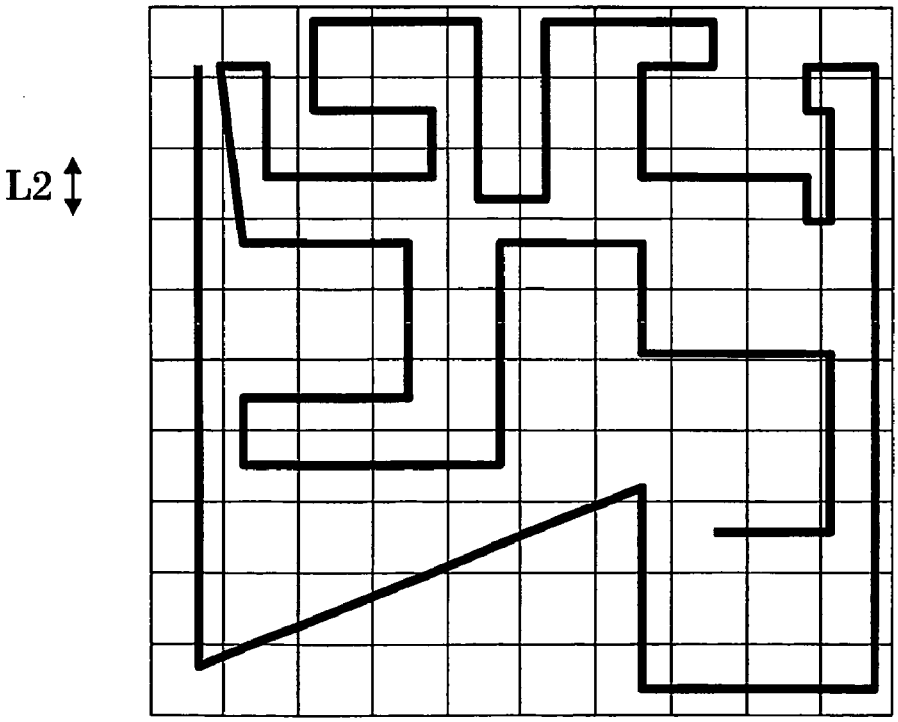

FIGS. 14 and 15 (below) illustrates an example of how the box-counting dimension of a curve is calculated. The example curve is placed under a 5×5 grid (FIG. 14) and under a 10×10 grid (FIG. 15). As illustrated, the example curve touches N1=25 boxes in the 5×5 grid and touches N2=78 boxes in the 10×10 grid. In this case, the size of the boxes in the 5×5 grid is twice the size of the boxes in the 10×10 grid. By applying the above equation, the box-counting dimension of the example curve may be calculated as D=1.6415. In addition, further miniaturization is achieved in this example because the curve crosses more than 14 of the 25 boxes in the 5×5 grid, and also crosses at least one box twice, that is, at least one box contains two non-adjacent segments of the curve. More specifically, the curve in the illustrated example crosses twice in 13 boxes out of the 25 boxes.

Some box-counting dimension curves might approach a self-similar or self-affine curves, while some others would rather become dissimilar, that is, not displaying self-similarity or self-affinity at all (see for instance FIG. 14 and FIG. 15).

Further embodiments of the invention are described in the dependent claims.

The invention claimed is:

1. An antenna system for motor vehicles comprising:

two antennas, wherein each of said two antennas is disposed on a plane, said planes being substantially parallel and spaced from each other at a predetermined distance, wherein each of said two antennas comprises a curve of conductive material, wherein a geometry of at least a part of said curve comprises a space-filling curve or a grid dimension curve, said curve having a box-counting dimension or grid dimension larger than 1.5, wherein each of said two antennas is an electrically small antenna, and wherein said two antennas are connected to a combiner unit which is adapted to add, in a frequency domain, a signal received from a first antenna of said two antennas to a signal received from a second antenna of said two antennas.

2. The antenna system according to claim 1, wherein the curve of conductive material of each said two antennas comprises at least two portions having different box-counting dimensions or different grid dimensions.

3. The antenna system according to claim 1, wherein the box-counting dimension or the grid dimension is larger than 1.9.

4. The antenna system according to claim 1, wherein each of said two antennas comprises a reactive load coupled to one end of the antenna or to a selected position along the space-filling curve of each antenna.

5. The antenna system according to claim 1, wherein said two antennas are connected together by a conductive layer at a top side of the antenna system.

6. The antenna system according to claim 1, wherein the two antennas have substantially the same geometric shape.

7. The antenna system according to claim 4, further comprising a metallic conductor electrically coupled to said two antennas, and wherein said conductor is arranged to act as a capacitive load for said antennas.

8. The antenna system according to claim 1, wherein each of said two antennas is printed on a dielectric substrate and an electronic active module or circuit which is placed separate to the antenna's system, and wherein the electronic active module or electronic circuit and at least one of said two antennas are connected by means of a wire or a coupling element.

9. The antenna system according to claim 1, wherein each of said two antennas is printed on a dielectric substrate and wherein an electronic active module or circuit is mounted on said substrate.

10. The antenna system according to claim 1, wherein the space-filling curve is a non-periodic curve which includes a number of connected substantially straight segments smaller than a fraction of the operating free-space wavelength, wherein the segments are arranged in such a way that no adjacent and connected segments form another longer straight segment, and wherein none of said segments intersect each other.

11. The antenna system according to claim 1, wherein the space-filling curve includes at least five segments, each of the at least five segments forming an angle with each adjacent segment in the curve, at least three of the segments being shorter than one-tenth of the longest free-space operating wavelength of the antenna.

12. The antenna system according to claim 11, wherein each angle between adjacent segments is less than 180° and at least two of the angles between adjacent sections are less than 115°, and at least two of the angles are not equal.

13. The antenna system according to claim 1, wherein the space-filling curve fits inside a rectangular area, the longest side of the rectangular area being shorter than one-fifth of the longest free-space operating wavelength of the antenna.

14. The antenna system according to claim 1, wherein the shape of the space-filling curve approach a self-similar or self-affine curve.

15. The antenna system according to claim 1, wherein the shape of the curve is not self-similar.

16. The antenna system according to claim 1, wherein at least part of the antenna curve is shaped as a Hilbert curve.

17. The antenna system according to claim 1, wherein each of the two antennas is an electrically small antenna which is enclosed within a sphere comprising a radius smaller than 50 cm.

18. The antenna system according to claim 1, further comprising an active module placed posterior to the combiner unit in order to increase the signal level obtained by said two antennas.

19. The antenna system according claim 1, wherein said two antennas form a part of a diversity system.

20. A diversity system comprising at least two antenna systems according to claim 1, wherein a diversity system adds signals coming from said at least two antenna systems with the same phase in order to obtain the optimum performance, the diversity system comprises a phase control unit to adjust the phase of the signals from said at least two antenna systems.

21. The antenna system according to claim 1, wherein at least one of said two antennas is adapted for a reception of radio AM/FM frequency bands.

22. The antenna system according to claim 1, wherein at least one of the two antennas is adapted to operate at AM (LW: 150 kHz-279 kHz and MW: 530 kHz-1710 kHz) Japan and European FM band (73 MHz-108 MHz).

23. The antenna system according to claim 1, wherein the antenna system is adapted to provide service for at least one band selected from a group comprising: GSM900, GSM1800, GPS, DAB, DTB, PCS1900, KPCS, CDMA, WCDMA, TDMA, UMTS, TACS, ETACS, SDARS, WiFi, WiMAX, UWB, Bluetooth, or ZigBee.

24. A motor vehicle comprising at least one antenna system as claimed in claim 1.

25. The motor vehicle according to claim 24, wherein the at least one antenna system is installed at an exterior surface of the motor vehicle next to vertexes and ends of the motor vehicle.

26. The motor vehicle according to claim 24 or 25, wherein the at least one antenna system is housed within a non-conductive cover.

27. The motor vehicle according to claim 26, wherein said cover is mounted on a back windscreen or on a front windscreen or on a ceiling of the motor vehicle.

28. The motor vehicle according to claim 24, wherein the antenna system is housed within a rear-view minor of the motor vehicle.

29. The motor vehicle according to claim 24, wherein at least one of the two antennas is short-circuited to the motor vehicle's electric ground.

30. The antenna system according to claim 17, wherein the radius of the sphere is smaller than $\lambda/10$, or smaller than $\lambda/20$ or smaller than $\lambda/40$, at the center of the FM band or other radio or wireless communication service.

31. The antenna system according to claim 1, further comprising:

two tunable antenna units; and two coaxial cables, wherein each of the two antennas is connected to the signal combining device through one of said two tunable antenna units and one of said two coaxial cables connected in series.

32. The antenna system according to claim 31, wherein each of said two tunable antenna units comprises lumped elements selected to adjust the antenna's self-resonant frequency.

33. The antenna system according to claim 31, wherein lengths of said two coaxial cables are different and are selected to provide an unequal phase division of the signal received by said two antennas.

34. The antenna system according to claim 1, wherein the signal combining device is a Surface-Mounted-Device transformer comprising two inputs for receiving signals respectively from said two antennas, and an output to provide a combination of said signals.

35. The antenna system according to claim 1, wherein the signal combining device comprises two input transmission lines for receiving signals respectively from said two antennas, and an output transmission line comprising one end connected to said input transmission lines.

36. The antenna system according to claim 1, wherein each of the two antennas is adapted to receive in different sub-bands of a desired bandwidth, and wherein the signal combining device is adapted to add in frequency all the signals in said sub-bands corning from the two antennas to obtain said desired antenna's bandwidth.

37. The antenna system according to claim 1, wherein the signal combining device is adapted to act as a microwave power divider with an equal power division to each of the two antennas connected, but with an unequal phase division to each antenna connected.

* * * * *